United States Patent [19]

Conrad

[11] 4,400,028

[45] Aug. 23, 1983

[54] REMOTE DRIVING TOOL WITH TUBULAR LOCK FEATURE

[76] Inventor: James R. Conrad, 1631 Grandview, Glendale, Calif. 91201

[21] Appl. No.: 256,077

[22] Filed: Apr. 21, 1981

[51] Int. Cl.[3] ..... A47F 13/06

[52] U.S. Cl. ..... 294/19 R; 403/365

[58] Field of Search ..... 294/19 R, 85, 88, 1 R, 294/22, 20, 21; 403/83, 365, 287; 273/12; 248/359, 317, 320, 339, 340, 360, 467, 544

[56] References Cited

U.S. PATENT DOCUMENTS

| | | | |
|---|---|---|---|
| 696,403 | 4/1902 | Blanton, Jr. . | |
| 886,991 | 5/1908 | Kroder . | |
| 1,006,427 | 10/1911 | Boraks . | |
| 1,578,781 | 3/1924 | Tredwell . | |
| 1,982,719 | 1/1934 | Woerner . | |
| 2,432,059 | 5/1946 | Zipser . | |
| 2,473,351 | 6/1949 | Thompson et al. . | |
| 2,526,415 | 10/1950 | Refsdal . | |
| 2,991,096 | 7/1961 | Davidson . | |
| 2,992,026 | 7/1961 | Farber . | |
| 3,391,954 | 7/1968 | Callahan . | |
| 3,514,510 | 4/1970 | Bernard et al. . | |
| 3,515,418 | 6/1970 | Hielsen, Jr. . | |
| 4,206,821 | 6/1980 | Emmerich | 403/365 |
| 4,225,108 | 9/1980 | Jaroche | 294/19 R |

FOREIGN PATENT DOCUMENTS

| | | |
|---|---|---|
| 356282 | 9/1961 | Fed. Rep. of Germany . |
| 677719 | 3/1930 | France . |

*Primary Examiner*—James B. Marbert

*Attorney, Agent, or Firm*—Wagner & Bachand

[57] ABSTRACT

Hand held, remote driving tool for driving a rotatable working head such as a lag bolt and hanger wire insertion head, at a distance otherwise beyond the reach of the tool operator, the tool comprising a rigid axially elongated tubular driver member adapted for coupling to a power drill, and a rigid, axially elongated tubular driven member adapted to carry a rotatable working head at its remote end for driving by the drill, the driven member at its near end being interfittable with the driver member at a predetermined locus of coextension; cooperating axial sections on the driver and driven members at the predetermined locus, the cooperating sections being relatively configured to bind the members selectively within the locus in a predetermined axially aligned and interfitted condition of the members and in a manner normally tending to binding release pivoting of the members relative to each other in response to side loading forces on one or both of said members in the use of the tool, and skirt means attached to the outer of the members defining a skirt extension thereof in engagement with the inner of the members beyond the locus, the skirt extension thereby blocking pivoting of the members from their predetermined axially aligned interfitted condition against binding release.

18 Claims, 10 Drawing Figures

REMOTE DRIVING TOOL WITH TUBULAR LOCK FEATURE

TECHNICAL FIELD

This invention has to do with a driving tool suited for extending the reach of the operator, e.g. to a building ceiling, to facilitate installation of anchoring bolts and hangers used in conjunction with hanging ceilings. More particularly, the invention is concerned with improvements in extensible, lockable driving tools adapted for carrying rotating working heads at a remote use points.

In the building trades, it has been the practice to hang false ceilings well below the horizontal floors of the structure, to accommodate air conditioning ducts, plumbing equipment, wiring and the like, and to adjust ceiling heights to comfortable levels for office workers. A common technique used is to drive a lag bolt having a vertical flange "head" into the underside of the flooring and secure a wire hanger to the lag bolt head through a hole provided for the purpose. Typically, this operation necessitates a worker positioning a ladder beneath the intended point of attachment climbing up with a lag bolt and wire, driving in the bolt, usually with a hand drill having a suitable chuck accommodating a plug shaped working head adapted to driving the bolt and twisting the wire through the head aperture and around itself the prescribed number of turns to support the ceiling tile frames and tiles to be later installed.

The winding of the wire is time-consuming and wearying and must be carried out in a manner to meet code standards. Because of the usual height of the ceilings worked on, the wires are long, e.g. 20 feet in length, and each couple of lag bolt anchors, at least, requires repositioning the ladder, and of course climbing up and down, repetitively.

The present invention eliminates the need to climb ladders by providing an extension tool able to be sized to the particular ceiling height, improves quality control by lessening fatigue on the job, and mechanically simultaneously effects lag bolt insertion and wire twisting thereon all at a distance so that the operator can simply walk around on the floor to each lag bolt location.

BACKGROUND ART

An important aspect of the present invention is the reliability of the tool. Extensible tools have been known before, e.g. in swimming pool cleaning apparatus, but unlike the present tool previously known tools have been deficient in use because of initially or subsequently inadequate locking of the tool at its desired extended length, particularly under torque loading, as occurs when a remote operating head is rotated. For example, plastic ferrules wedged between interfitting tubular members wear severely in time. The present tool is particularly well suited to use with rotating heads or drives since locking is not adversely affected by torques experienced in use. Thus, the tool may be driven by an ordinary hand operated power drill without loss of locking, and despite counter-torques that may be experienced, e.g. from lag bolts being driven by the tool which in turn is being driven by a drill.

The tool finds particular utility in the building industry, but is also useful wherever a working head, be it a cement smoothing bull float, or a swimming pool vacuum head or brush head, is applied at a distance and in a manner subjecting the tool between the operator and the head to torque forces and/or compression forces.

DESCRIPTION OF THE INVENTION

It is a major objective of the present invention to provide a driving tool which can be extended or contracted and locked in any particular length relation with a rotatable working head in use position thereon. It is a more specific objective to provide a driver tool particularly adapted to the remote installation of anchor bolts for suspended ceilings. A highly particular object is the provision of improved locking means for driving tools, including differentially shaped interfitting members and a separately formed skirt extension which ensure maintenance of the locked relation by blocking pivoting of the bound members which otherwise tends to work the locking loose, particularly under side loading, sporadic rotational or compressive stress.

These and other objects of the invention to become apparent hereinafter, are realized in a hand held, remote driving tool for driving a rotatable working head such as a lag bolt and hanger wire insertion head, at a distance otherwise beyond the reach of the tool operator, which comprises a rigid, axially elongated tubular driver member adapted for coupling to a power drill, and a rigid, axially elongated tubular driven member adapted to carry a rotatable working head at its remote end for driving by the drill, the driven member at its near end being interfittable with the driver member at a predetermined locus of coextension; cooperating axial sections on the driver and driven members at said predetermined locus, the cooperating sections being relatively configured to bind the members selectively within the locus in a predetermined axially aligned and interfitted condition of the members and in a manner normally tending to pivoting release from binding of the members relative to each other in response to side loading forces on one or both of the members in the use of the tool, and skirt means extending beyond the outer of the members defining a skirt extension thereon, the skirt extension being in engagement with the inner of the members beyond the predetermined locus against release of the members from binding in pivoting response to side loading forces.

As noted, the present driving tool is advantageously combined with a working head interfitted with the remote end of the driven member, the working head comprising means adapted to support a lag bolt having a bolt head through which the bight of a bent hanger wire is inserted, and means capturing the hanger wire on opposite sides of the bight for twisting the wire on itself to lock the wire hanger on the lag bolt responsive to working head rotation. Additionally, the present driving tool is usefully combined with a power rotary drill, and coupling means drivingly interconnecting the driver member and the drill. In highly preferred embodiments, the driving tool is combined with both a working head interfitted with the remote end of the driven member, the working head comprising means adapted to support a lag bolt having a bolt head through which the bight of a bent hanger wire is inserted, and means capturing the hanger wire on opposite sides of the bight for twisting the wire on itself to lock the wire hanger on the lag bolt responsive to working head rotation, and a power rotary drill, with coupling means drivingly interconnecting the driver member and the drill in working head rotating, wire twist locking relation.

In any of the embodiments of the invention, the driver and driven members are preferably fabricated of aluminum of a wall stiffness to be substantially inflexible under binding forces; the skirt means is separately formed of synthetic organic thermoplastic polymer; the skirt means comprises an annular continuation of the outer member locally deflected into inner member engagement beyond a locus of relative nonengagement; an interiorly mounted means may be provided locally stiffening the inner member against member engagement induced deflection facilitating nonbinding of the relatively rotated members; the skirt means may comprise a plug having a stepped bore, the bore being in inner member engagement along the relatively smaller bore diameter, and in outer member engagement along the relatively larger bore diameter, whereby the plug defines a skirt extension for the inner member; a resinous adhesive may be provided supporting the members in their aligned relation; the driver and driven members are each generally annular and relatively diametrically sized to slidably telescope, each of the members being locally out of round in its cooperating axial section to bind on each other distributively along diametrically opposed paraxial lines of engagement through the locus of coextension; and the driver member partially receives the driven member, the skirt means comprises a separately formed annular structure seated on the driver member in axially slidable engagement with the driven member against binding disengagement release of the members.

In the present invention driving tool, the driver and driven members interfit, and thus differ in their respective diameters. Typically, the inside diameter of the outer member exceeds in diameter the outside diameter of the inner member by at least 1%, and up to 5% to 25% and more. The local out-of-round sections of the outer of the members being reduced not less than about 0.5% in diameter, and the locally out-of-round section of the inner of the members being reduced not less than about 2% in diameter, whereby relative rotation of the members binds the members on each other. In such embodiments too, the members are preferably fabricated of aluminum of a wall thickness to be substantially inflexible under binding forces, and the skirt means is fabricated of synthetic organic thermoplastic polymer.

In an embodiment adapted to the building trades, the invention comprises in combination with a working head, a tool comprising a rigid axially elongated annular driver member defining means for coupling to a power drill, and a rigid, axially elongated annular driven member carrying the working head at its remote end for driving by the drill, and an intermediate member into opposite ends of which the driver and driven members are fitted at respective predetermined locus of coextension; cooperating locally out-of-round, axially extended sections on the driver or driven member within the predetermined locus defining a diametrical difference between the members whereby the cooperating sections will not mutually pass each other on relative rotation of the members but will bind the members selectively in a predetermined axially aligned an interfitted condition of the members and in a manner normally tending to release the members by pivoting relative to each other in response to side loading forces on one or both of the members in the use of the tool, and separately formed skirt means attached to the driver member defining a skirt extension thereof in snug but slidable engagement with the driven member beyond the locus a distance enabling the skirt extension to block pivoting of the members from their predetermined axially aligned interfitted condition and thereby prevent unbinding.

THE DRAWING

The invention will be further described as to an illustrative embodiment thereof in conjunction with the attached drawings, in which.

PREFERRED MODES

Figure 1:
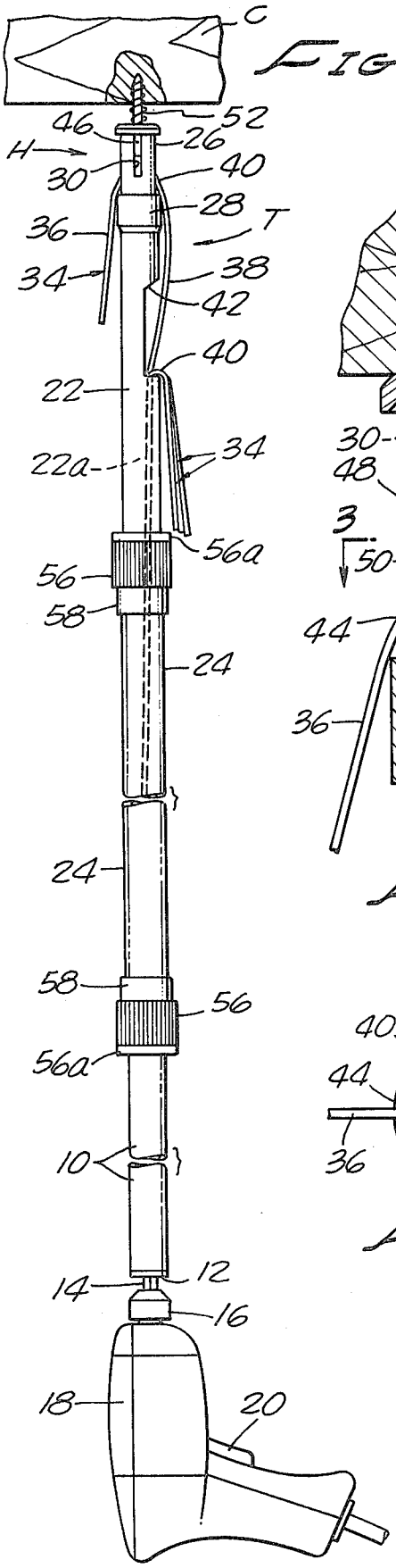
FIG. 1 is a side elevation view of the apparatus in use applying lag bolt supported wire hangers to a ceiling section; the tool of the invention.

With reference now to the drawings in detail, and particularly FIGS. 1–6, the tool T of the invention comprises an aluminum tubing driver member 10 having an fitting 12 into which is inserted shaft 14 extending from chuck 16 driven by hand held power drill 18. The operator (not shown) holds the drill 18 in his hand with the chuck 16 pointing upward as shown and depresses the drill trigger 20 with his thumb to rotate the driver member 10 accordingly.

The tool T further comprises an aluminum tubing driven member 22, shown coupled to the driver member 10 through a driver-driven member 24, also suitably formed of aluminum tubing. The lengths of the driver and driven member(s) and their number will be determined by the height at which operations are to be performed.

The upper driven member 22 is surmounted by a working head H which comprises a metal plug body 26 interfitted with a flared portion 28 of the upper driven member, the body having transverse slots 30, 32 cut therein.

Figure 2:
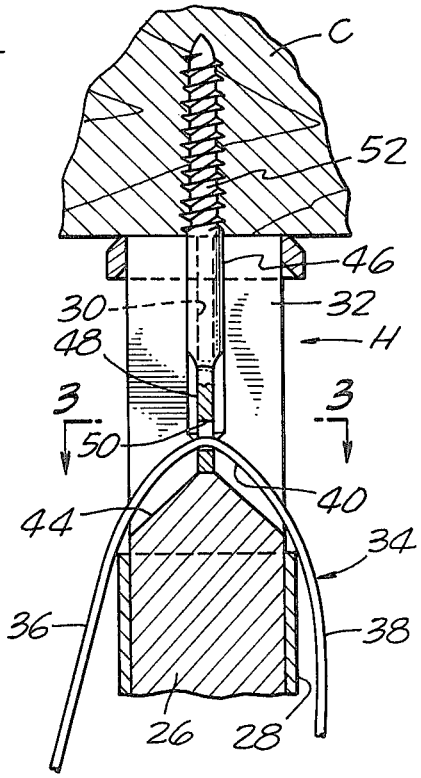
FIG. 2 is a detail view, generally in section of a typical rotatable working head used to twist the lag bolt engaged wire hanger.
Figure 3:
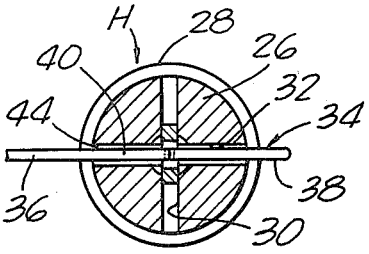
FIG. 3 is a view in section, taken on line 3—3 in FIG. 2.
Figure 4:
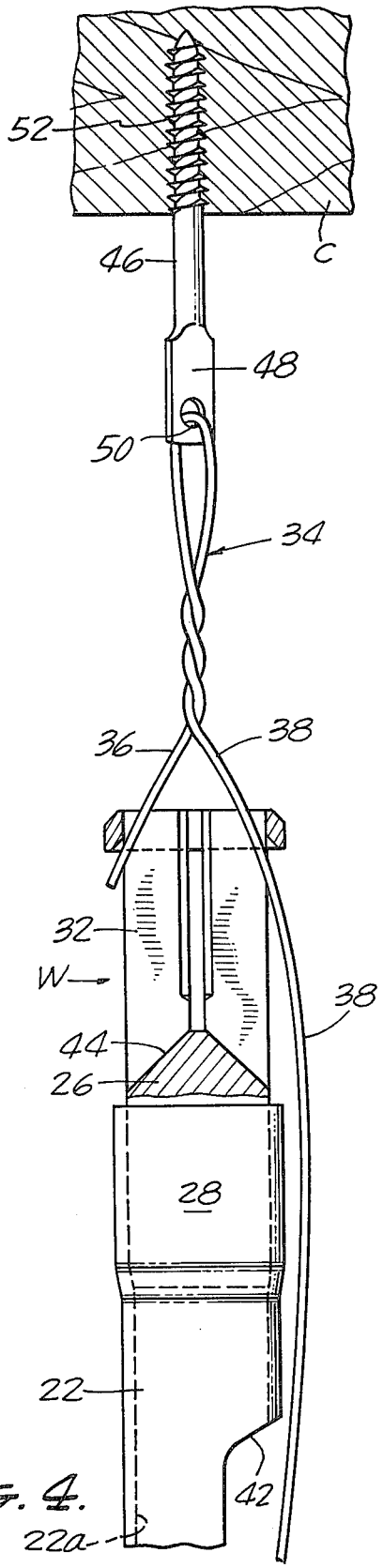
FIG. 4 is a view like FIG. 1, but showing the working head being withdrawn as the wire hanger is twisted, the lag bolt having been seated in the ceiling section.

Wire hangers 34 are provided having a short leg 36 and a long leg 38 sufficient to hang a suspended ceiling at a desired height, and a bight 40 therebetween. The wire hangers 34 are initially stored within the hollow interior **22*a* of upper driven member 22 inward of member cut-out 42. In use, a single wire hanger 34 is lifted slightly and turned inward so that it may be inserted, short leg 36 first into the slot 32, so that the bight 40 rests on shoulder 44 and the long leg 38 remains within the driven member hollow interior 22*a*. In this manner, dangerous centrifugal whipping of long leg 38 during working head H rotation is avoided. A lag bolt 46 having a flat head 48 with a central aperture 50 is set in slot 30 before the wire hanger leg 36 is passed through slot 32, whereby the leg 36 passes through the bolt aperture 50 and both the bolt head 48 and the wire bight 40 are trapped in their respective slots. Installation of the bolt 46 in the ceiling section C is accomplished by the operator pushing upward with the drill, while actuating the trigger 20, rotating the driven member 10, the driver-driven member 24, the driven member 22 and the working head H. The threaded portion 52 of the bolt 46 enters the ceiling C as shown in FIGS. 1 and 2. Entry of the bolt accomplished, the tool T is lowered, as rotation is continued, see FIG. 4, whereby the short leg 36 of the wire hanger is twisted around the hanger longer leg 38 by the action of the slots 30, 32 on the wire hanger bight 40 and the bolt head 48**, the requisite number of turns required by local codes.

Figure 5:
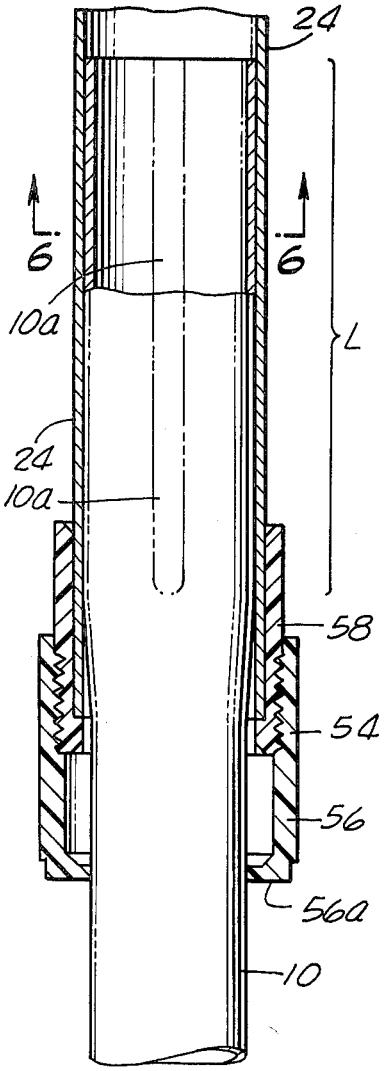
FIG. 5 is an enlarged fragmentary view in section of the tubular lock feature of the apparatus shown in FIGS. 1–4.
Figure 6:
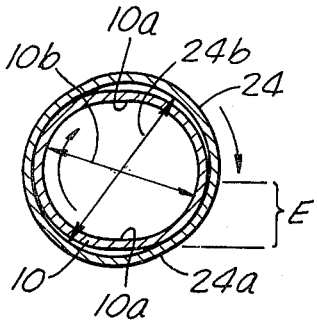
FIG. 6 is a transverse section view thereof taken on line 6—6 in FIG. 5.

This invention is particularly concerned with enabling the reliable, remote effectuation of the described lag bolt insertion and subsequent wire twisting. The tool T lets the operator stand on the building floor to accomplish the task, rather than to have to climb a ladder for each or each several insertions. The tool T, with particular reference to FIGS. 1, 5 and 6, comprises the assembly of driver member 10, intermediate (driven and driver) member 24, and driven member 22, and will be described with particular reference to the driver member 10 and the member 24, it being evident that the driven member 22 is connected to the intermediate member 24 like the member 24 is connected to the member 10, i.e. the diametrically greater member bodily receives more or less of the diametrically lesser member, depending on the extension desired for effective operation, to define for the interfitted members a locus of coextension L and determined by the relative common extents of the members. For tool T length adjustment, the tool members 10, 24 are rotated to be free of mechanical engagement in their locus of coextension L, slid past each other axially to a greater or less coextension. With reference to FIG. 5, lengthwise axial adjustment requires that the members 10, 24 be rotated from the relation shown. In FIG. 6, it will be observed that the members 10 and 24 have portions **10*a* and 24*a* depicted to be out-of-round despite the generally annular nature of these members, and further that the major transverse axes 10*b* and 24*b* respectively, of these members, if approximately parallel, would provide a clearance at all points between the members. In this relation, the tool members 10, 24** will slip past each other for length adjustment of the tool T.

In FIG. 6, however, the members 10 and 24 have been rotated so that their major axes **10*b*, 24*b* are not parallel. In this adjustment condition, the two members 10 and 24 bind on each other along a wide line of axially distributed engagement E on opposite sides of the members within the locus of coextension L and against unwanted shifting of the one member relative to the other when lag bolt 46 is driven upward as earlier described, and torque and countertorque forces and side loading are experienced. The longitudinal extent of the engagements E is determined by the axial extent of the relatively out-of-round portions 10*a* and 24*a* of the two members 10 and 24**, and their circumferential extent by the relatively incongruity of the members in their out-of-round portions.

It has been found that binding locks of great strength, assuming adequate wall stiffness and strength in the members 10 and 24 themselves against flexing, are realized where the difference between the inner diameter of the outer or driven member e.g. 24 and the outer diameter of the inner or driver member e.g. 10 is not less than about 1%, up to 5 to 25% and more, and the opposed walls of the members are deflected inwardly to define the mentioned flats, **10*a*, 24*a*, e.g. by reducing the diameter of the outer member not less than 0.5%, to 99.5% of the original diameter, and preferably by 1.5% up to 25% or more, and reducing the original diameter of the inner member by not less than 2%, and preferably by 4%, up to 35% and more in the cooperating sections, all reduction values being such as to provide sufficient mechanical interference to effect the purposes of the invention: a binding lock between members upon their relative rotation. It has further been found that for maximum locking effect, and optimum resistance to failure from either passing through the lock, or freezing, i.e. irretrievable locking up of the members 10, 24** under drill driving, that the diameter difference between the members are differentially reduced e.g. at a 30/70 ratio of the outer member diameter decrease to the inner member diameter decrease (e.g. reduce the outer member diameter by 1.5% and the inner member diameter by 3.5%, reductions found effective for aluminum tubing assemblies having an inner member outside diameter of $1\frac{1}{4}$ inch, and an outer member inside diameter of 1 1/6 inch.

The locally out-of-round portions **10*a*, 24*a* are readily formed by compression between steel rollers of a part of the axial extent of the members 10, 24**, respectively.

Effective as the binding interfittment of relatively ovaled members 10, 22, and 24 is, in use the lock will not hold, because the two point (albeit longitudinally extended point or line) contact, i.e. engagement E, as viewed from above, of one member with the other permits cocking or rocking from side to side, or other pivoting motion as the axial alignment of the members is changed by side loading encountered in use of the tool T. It has been found that this tendency to pivot must be controlled, blocked if possible, for effective reliable, and continuing locking between the members 10 and 24, and between members 24, 22. After considerable experimentation, it has been found that a skirt 54 having an extension 56 must be fitted to the member 24 in a manner to limit pivoting. For this purpose, the present invention provides, in one embodiment, a separately formed annular skirt 54, of e.g. suitable plastic, rigid but not brittle, and sized to seat firmly on preferably the outer member 24, on a collar 58 threaded to mount the skirt 54 or by other means, and to extend vertically beyond the locus of coextension L and circumferentially beyond the lines of engagement E, a finite distance, e.g. beyond the locus of coextension a minimum linear distance equal to from 1 to 15 times the outer member diameter, with its extension 56 defining a ring **56*a* sized to snugly but slidable encircle the inner, e.g. driver, member 10. In this manner, member 10 is supported laterally at a point (actually a circular and axial series, or cylinder, of points) spaced from the pivoting connection defined by the engagement E within the locus L beyond the outer member 24, preventing relative member pivoting, by stabilizing the member 24 against the member 10 using the outer member (and collar 58 thereon) as a fulcrum. With the described skirt 54 and extension 56**, the present lock system outperforms all other lock systems based on dissimilar shaped interfitting tubes.

Figure 7:
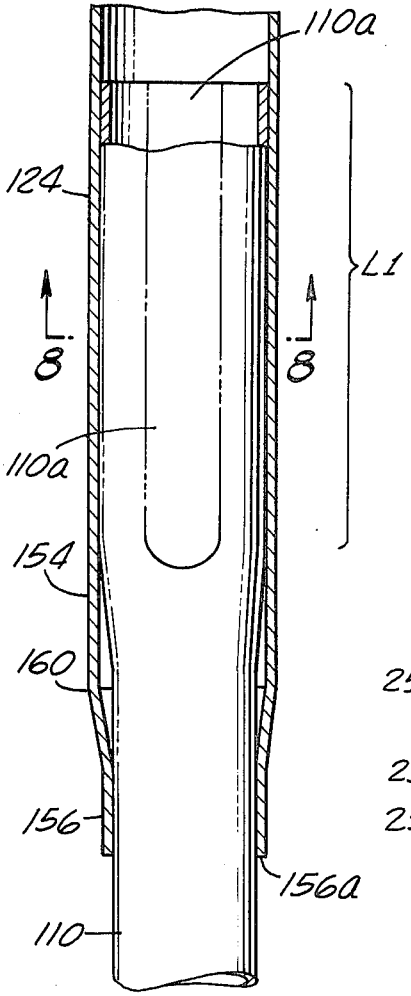
FIG. 7 is a view like FIG. 6 of an alternate form of the invention.
Figure 8:
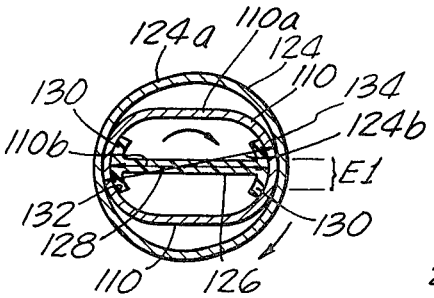
FIG. 8 is a transverse section view thereof taken on line 8—8 in FIG. 7.

In other embodiments, the skirt 54 and extension 56 are modified. With reference to FIGS. 7 and 8, for example, the driver member 110 is received within driven member 124 throughout a locus of coextension L1, the members being shown with their major axes 110*b*, 124*b* angularly related, and not parallel, from which orientation they can be rotated to be axially coparallel, so as to be longitudinally adjustable. Member 124 has a flat 124*a* on either side of its major axis 124*b*; and flats 110*a* are similarly provided on member 110 flanking its major axis 110*b*. Relative rotation of the members 110, 124 will result in mechanical interference of the members at lines of engagement E1, and binding locking. Member 110 is additionally provided with a spider 126 which is mounted interiorly of the member, to have its central web 128 parallel with the member major axis 110*b* and contoured heads 130 at either end of the web, flush against the inside walls 132 of the member. The spider 126 is located opposite the line of engagement E1 to resist deflection of the member 110 on repeated lockings, and to block the member turning through the lock. If desired, adhesive, such as epoxy 134, can be placed between the interfitted tubular members in any of the various embodiments for more permanent adjustment, e.g. between 110 and 124 in FIGS. 7 and 8.

Pivoting of the members 110 and 124 relative to each other is blocked, in the FIGS. 7, 8 embodiment, by a skirt 154 formed on the terminus of the member 110 by outwardly deflecting the tubing from within, and then necking-in the tubing beyond a break 160, to define a skirt extension 156 with its ring 156*a* which snugly embraces the inner member 110 beyond the locus of coextension L1, and thus prevents rocking of the inner member within the outer 124.

Figure 9:
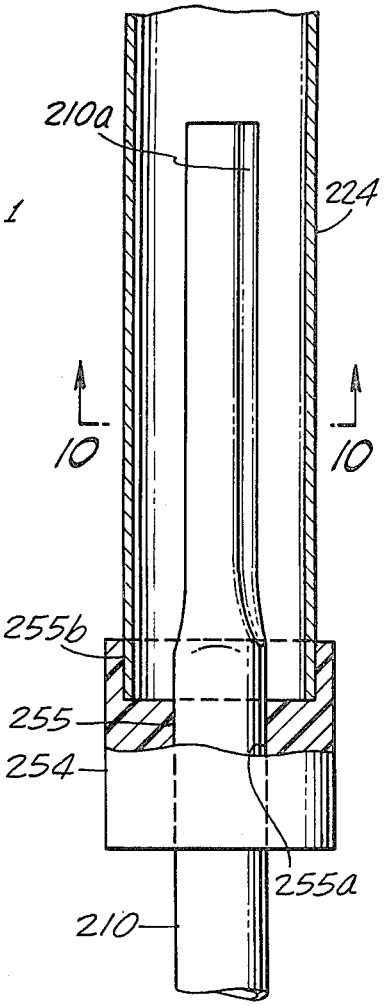
FIG. 9 is a view like FIG. 6 of another alternate form of the invention; and, FIG. 10 is a transverse section view thereof taken on line 10—10 in FIG. 9.
Figure 10:
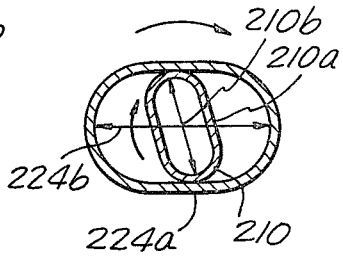

In FIGS. 9 and 10 another embodiment of the invention is depicted, this one featuring a relatively reduced diameter driver member 210 having opposed flats 210*a* on either side of its major axis 210*b*, and a driven member 224 having like flats 224*a* relative to axis 224*b*. The member 210 carries a plug 254 having a stepped bore 255, the smaller portion 255*a* of which journals the inner, driver member 210, and the larger portion 255*b* of which receives snugly the terminus of member 224. The relative congruity of the members 210 and 224 is such that rotation therebetween for a full revolution is not possible, see FIG. 10. When thus locked, the plug 254, with its skirt extension 256 defined by the walls of bore portion 255*a* blocks relative pivoting, and thus unbinding, of the members 210, 224.

The materials of fabrication of the driving tool T are as indicated aluminum tubing for the interfitted members, although other materials formable into tubing for the interfitted members, although other materials formable into tubing of requisite stiffness, including metals and synthetic organic thermoplastics may be used. The skirt if separately formed, e.g. as in the embodiments of FIGS. 1–6, and 9, 10, is suitably fabricated of synthetic organic thermoplastics such as polyolefin plastics, e.g. polyvinyl chloride, polyethylene, polypropylene and the like and copolymers of olefin plastics.

Thus the objectives of an easily adjusted, variable length driving tool are met by the present structure, and with a reliable lock feature which prevents unwanted unlocking from relative pivoting of the adjusted, locked members.

I claim:

1. Hand held, remote driving tool for driving a rotatable working head such as a lag bolt and hanger wire insertion head, at a distance otherwise beyond the reach of the tool operator, said tool comprising a rigid axially elongated tubular driver member adapted for coupling to a power drill, and a rigid, axially elongated tubular driven member adapted to carry said rotatable working head at the driven member remote end for driving by said drill, said driven member at its near end being interfittable with said driver member at a predetermined locus of coextension; cooperating axial sections on said driver and driven members at said predetermined locus, said cooperating sections being relatively configured to bind said members selectively within said locus in a predetermined axially aligned and interfitted condition of said members and in a manner normally tending to pivoting release from binding of the members relative to each other in response to side loading forces on one or both of said members in the use of the tool; and skirt means extending beyond the outer of said members defining a skirt extension thereon, said skirt extension being in engagement with the inner of said members circumferentially beyond said predetermined locus against release of said members in pivoting response to side loading forces.

2. In combination: the driving tool of claim 1, and a working head interfitted with the remote end of said driven member, said working head comprising means adapted to support a lag bolt having a bolt head through which the bight of a bent hanger wire is inserted, and means capturing the hanger wire on opposite sides of the bight for twisting the wire on itself to lock the wire hanger on the lag bolt responsive to working head rotation.

3. In combination: the driving tool of claim 1, a power drill, and coupling means drivingly interconnecting said driver member and said drill.

4. In combination: the driving tool of claim 1, a working head interfitted with the remote end of said driven member, said working head comprising means adapted to support a lag bolt having a bolt head through which the bight of a bent hanger wire is inserted, and means capturing the hanger wire on opposite sides of the bight for twisting the wire on itself to lock the wire hanger on the lag bolt responsive to working head rotation, a power drill, and coupling means drivingly interconnecting said driver member and said drill in working head rotating, wire twist locking relation.

5. Driving tool according to claim 1, in which said driver and driven members are fabricated of aluminum of a wall stiffness to be substantially inflexible under binding forces.

6. Driving tool according to claim 1, in which said skirt means is separately formed of synthetic organic thermoplastic polymer.

7. Driving tool according to claim 1, in which said skirt means comprises an annular continuation of said outer member locally deflected into inner member engagement beyond a locus of relative nonengagement.

8. Driving tool according to claim 1, in which said skirt means comprises a plug having a stepped bore, said bore being in inner member engagement along the relatively smaller bore diameter, and in outer member engagement along the relatively larger bore diameter, whereby said plug defines a skirt extension for said inner member.

9. Driving tool according to claim 1, including also interiorly mounted means locally stiffening said inner member against member engagement induced deflection.

10. Driving tool according to claim 1, including also resinous adhesive supporting said members in their aligned relation.

11. Driving tool according to claim 1, in which said driver and driven members are each generally annular and relatively diametrically sized to slidably telescope, each of said members being locally out of round in their cooperating sections to bind on each other distributively along diametrically opposed paraxial lines of engagement through said locus of coextension.

12. Driving tool according to claim 11, in which said driver member partially receives said driven member, said skirt means comprises a separately formed annular structure seated on the driver member in axially slidable engagement with said driven member against binding disengagement release of said members.

13. Driving tool according to claim 12, in which the driver and driven members differ in diameter by at least 1%, the local out-of-round section of the outer of said members being reduced not less than about 0.5% in diameter, and the local out of round section of the inner of said members being reduced not less than about 2% in diameter, whereby relative rotation of said members binds said members on each other.

14. Driving tool according to claim 13, in which said driver and driven members are fabricated of aluminum of a wall stiffness to be substantially inflexible under binding forces.

15. Driving tool according to claim 14, in which said skirt means is fabricated of synthetic organic thermoplastic polymer.

16. In combination: the driving tool of claim 15, and a working head interfitted with the remote end of said driven member, said working head comprising means adapted to support a lag bolt having a bolt head through which the bight of a bent hanger wire is inserted, and means capturing the hanger wire on opposite sides of the bight for twisting the wire on itself to lock the wire hanger on the lag bolt responsive to working head rotation.

17. In combination: the driving tool of claim 16, a power drill, and coupling means drivingly interconnecting said driver member and said drill.

18. In combination a hand held, remote driving tool, and a rotatable working head for hanger wire twisting at a distance otherwise beyond the reach of the tool operator, said tool comprising a rigid axially elongated annular driver member defining means for coupling to a power drill, and a rigid, axially elongated annular driven member carrying said working head at its remote end for driving by said drill, and an intermediate member into opposite ends of which said driver member and said driven member are fitted at respective predetermined locus of coextension; cooperating, locally out-of-round, axially extended sections on said fitted members within said predetermined locus defining a diametrical difference between the members whereby said cooperating sections will not mutually pass each other on relative rotation of the members but will bind said members selectively in a predetermined axially aligned and interfitted condition of said members and in a manner normally tending to release of the members by pivoting relative to each other in response to side loading forces on one or both of said members in the use of the tool, and separately formed skirt means attached to the driver member defining a skirt extension thereof in snug but slidable engagement with the driven member beyond said predetermined locus a distance enabling said skirt extension to block pivoting of said members from their predetermined axially aligned and interfitted condition and thereby prevent unbinding.

* * * * *